United States Patent [19]

Spinner

[11] Patent Number: 4,957,245

[45] Date of Patent: Sep. 18, 1990

[54] TEXTILE WINDING MACHINE

[75] Inventor: Hermann Spinner, Wetzikon, Switzerland

[73] Assignee: W. Schlafhorst & Co., Fed. Rep. of Germany

[21] Appl. No.: 373,149

[22] Filed: Jun. 28, 1989

Related U.S. Application Data

[63] Continuation-in-part of Ser. No. 190,484, May 5, 1988, abandoned.

[30] Foreign Application Priority Data

May 6, 1987 [IT] Italy ..... 83369 A/87

[51] Int. Cl.[5] ..... B65H 54/20; B65H 67/06

[52] U.S. Cl. ..... 242/35.5 A; 242/35.5 R

[58] Field of Search ..... 242/35.5 A, 35.5 R

[56] References Cited

U.S. PATENT DOCUMENTS

| | | | |
|---|---|---|---|
| 3,160,359 | 12/1964 | Furst | 242/35.5 R |
| 3,739,996 | 6/1973 | Matsui et al. | 242/39 |
| 4,315,607 | 2/1982 | Felix | 242/39 |
| 4,541,578 | 9/1985 | Kawarabashi et al. | 242/35.5 A |

FOREIGN PATENT DOCUMENTS

| | | | |
|---|---|---|---|
| 0026160 | 4/1981 | European Pat. Off. | 242/35.5 A |
| 3604018 | 9/1987 | Fed. Rep. of Germany | 242/35.5 A |

*Primary Examiner*—Stanley N. Gilreath

[57] ABSTRACT

A textile winding machine for producing cross-wound packages for subsequent use of the packages in pairs in simultaneously twisting and doubling yarn during which twisting and doubling the length of yarn drawn from one package of a pair is different from the length of yarn drawn from the other package of the pair. The winding stations are controlled to produce alternate packages with different lengths of yarn for use of alternate packages from each winding station as a pair of packages in the subsequent simultaneous twisting and doubling. A conveyor conveys the package pairs from the winding stations to a discharge end and the package pairs are deposited on the conveyor in either side-by-side relation or in sequence by the use of releaseable stops on platforms at the winding stations on which the wound packages are received and retained for release onto the conveyor after both packages of a pair have been wound.

8 Claims, 4 Drawing Sheets

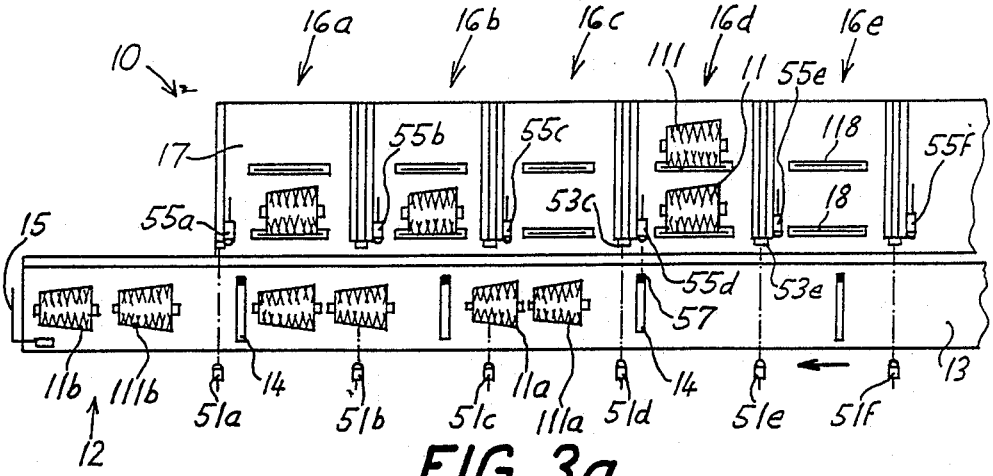
FIG. 3a
FIG. 3b
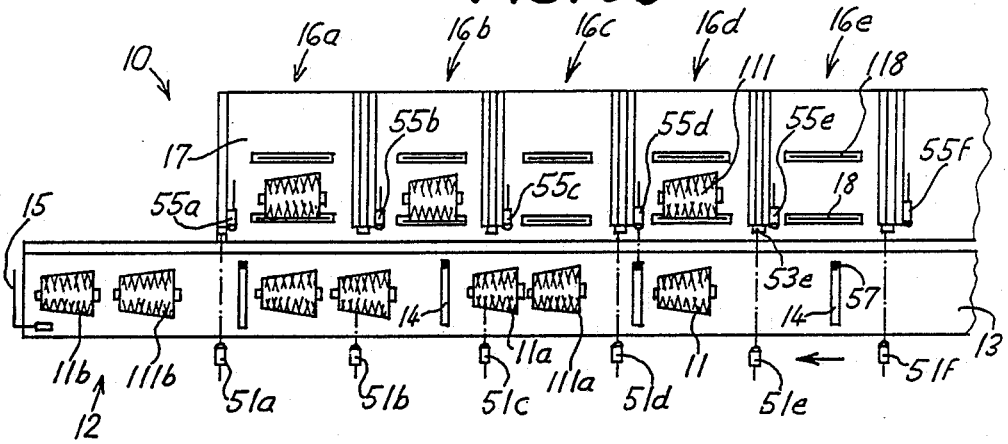
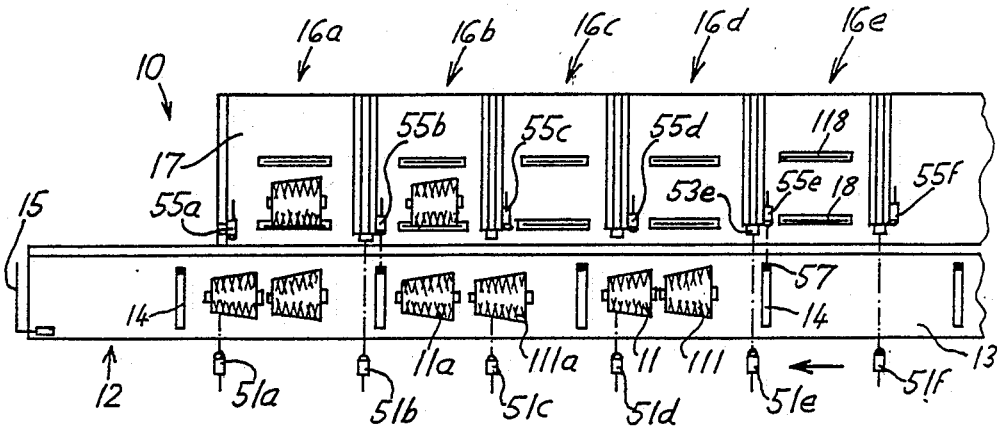
FIG. 3c

TEXTILE WINDING MACHINE

CROSS REFERENCE TO RELATED APPLICATION

This is a continuation-in-part of co-pending U.S. Pat. Application Ser. No. 190,484, filed May 5, 1988, entitled "A Textile Winding Machine", now abandoned.

BACKGROUND OF THE INVENTION

The present invention relates to textile winding machines and more particularly to winding machines for producing cross-wound packages for subsequent use of the packages in pairs in simultaneously twisting and doubling yarn during which twisting and doubling the length of yarn drawn from one package of a pair is different from the length of yarn drawn from the other package of the pair.

It is known that yarns being doubled from different packages in machines such as two-for-one twisters do not behave identically. In most arrangements of this type, the packages are arranged vertically with one package creeled above the other, with the yarn drawn from the lower package being subjected to a greater tension than the yarn drawn from the upper package with the result that more yarn is drawn from the upper package than from the lower package. When both packages have the same length of yarn wound thereon the upper package will be depleted before the lower package with a residue of yarn remaining on the lower package that creates a problem in reusing or is a waste if discarded. This situation is especially disadvantageous when processing yarns having significant elasticity. Wool yarn is an example of a yarn that is notably subject to this disadvantage.

Winding systems have been developed to produce packages with different lengths of yarn on the same winding machine so that the different length packages can be subsequently used in simultaneous twisting and doubling with the upper package having the lesser yarn. These systems operate with some of the winding stations controlled to produce packages having less yarn wound thereon than at other winding stations. To accomplish this the winding stations can be controlled to wind different lengths of yarn at different time intervals or, e.g., half of the winding stations can be controlled to produce packages with more yarn thereon and the other half controlled for winding less yarn thereon. This is disclosed in Italian patent document 60456 B/79.

However, these known systems involve disadvantages in that the length of yarn wound at different winding stations may vary and, although the variation may not be great, continual yarn waste will result in the twisting and doubling operation.

Another disadvantage of the known systems is that of handling the yarn packages automatically so that when they come from different winding stations or from different halves of the winding machine, they will be discharged from the winding machine or presented for assembly in the subsequent processing in proper pairs of longer and shorter yarn length packages.

SUMMARY OF THE INVENTION

The present invention overcomes the disadvantages recited above by producing cross-wound bobbins at winding stations that are operable to produce alternate packages with different lengths of yarn thereon for use of alternate packages from each winding station as a pair of packages in subsequent simultaneous twisting and doubling. Thus, packages of differing length yarn are produced at the same winding station and these packages are presented as a pair for subsequent twisting and doubling.

The winding stations can be controlled to produce the longer length yarn package first and the shorter length yarn package second, or vice versa. A conventional length-measuring device can be preset to regulate the difference in yarn length being wound on the packages. Switching means can be used to switch the winding from one length to the other at the end of winding of each bobbin. Such length-measuring devices and switching means can be located in each winding station or, more advantageously, they can be disposed in a central control mechanism.

If a pair of packages with different lengths of yarn are to be wound at a winding station, the conventional length-measuring device can be reset following the winding of the first package to measure the length of yarn wound onto the second package.

Briefly described, the present invention provides a textile winding machine for producing cross-wound yarn packages for subsequent use of the packages in pairs in simultaneously twisting and doubling yarn during which twisting and doubling the length of yarn drawn from one package of a pair is different from the length of yarn drawn from the other package of the pair. The winding machine comprises winding stations operable to produce, at each station, alternate packages with different lengths of yarn thereon for use of alternate packages from each winding station as a pair of packages in subsequent simultaneous twisting and doubling. The winding machine further includes means for conveying the pairs of packages from the winding stations with the packages of each pair being retained together and each pair being segregated from the other pairs.

Preferably, the conveying means includes a conveyor for conveying wound packages from the winding stations to a discharge end of the machine and means for depositing pairs of the wound packages from the winding stations onto the conveyor. The package depositing means may deposit the packages of the pairs in side-by-side relation onto the conveyor or in an alternate form the package depositing means can deposit the packages of the pairs in sequence onto the conveyor.

In the preferred embodiment, the package depositing means also includes a package supporting platform at each winding station for supporting yarn packages prior to depositing the packages in pairs onto the conveyor. With the use of a platform, at least one releaseable stop is included at each winding station for retaining the packages on the platform and for controlled release of pairs of packages for deposit onto the conveyor. For side-by-side depositing of the packages onto the conveyor, only a single stop is necessary. In depositing the packages of the pairs in sequence onto the conveyor, two releaseable stops can be utilized for separately retaining and releasing the packages in end-to-end relation onto the conveyor.

With the winding machine of the present invention the first package of each pair produced at each winding station is retained at the winding station until the second package has been wound and then both packages are released as a pair for delivery by the conveyor to a discharge end of the machine, from which they are then delivered to a machine for subsequent twisting and doubling. When the packages are conveyed in sequence, sequential packages form the pair of packages of different yarn lengths.

The pairs of packages can be conveyed to a single discharge location or two or more discharge locations can be utilized.

Further features and advantages of the present invention will be apparent from the accompanying drawings and the following detailed description of the preferred embodiments.

BRIEF DESCRIPTION OF THE DRAWINGS

FIG. 3*a* is a partial top plan view of another embodiment of the textile winding machine of the present invention, showing a plurality of pairs of packages, each package of a pair having a different length of yarn, supported on a conveyor for transport to a further handling location and showing a winding station of the winding machine having a pair of packages of different lengths of yarn in position for loading onto the conveyor;

FIG. 3*b* is a partial top plan view of the winding machine shown in FIG. 3*a*, showing one of the packages of the one winding station station loaded onto an empty space in the conveyor;

FIG. 3*c* is a partial top plan view of the winding machine shown in FIG. 3*a* and 3*b*, showing the other package of the pair of packages at the one winding station after it has been loaded onto the conveyor.

DETAILED DESCRIPTION OF THE PREFERRED EMBODIMENTS

Figure 1:
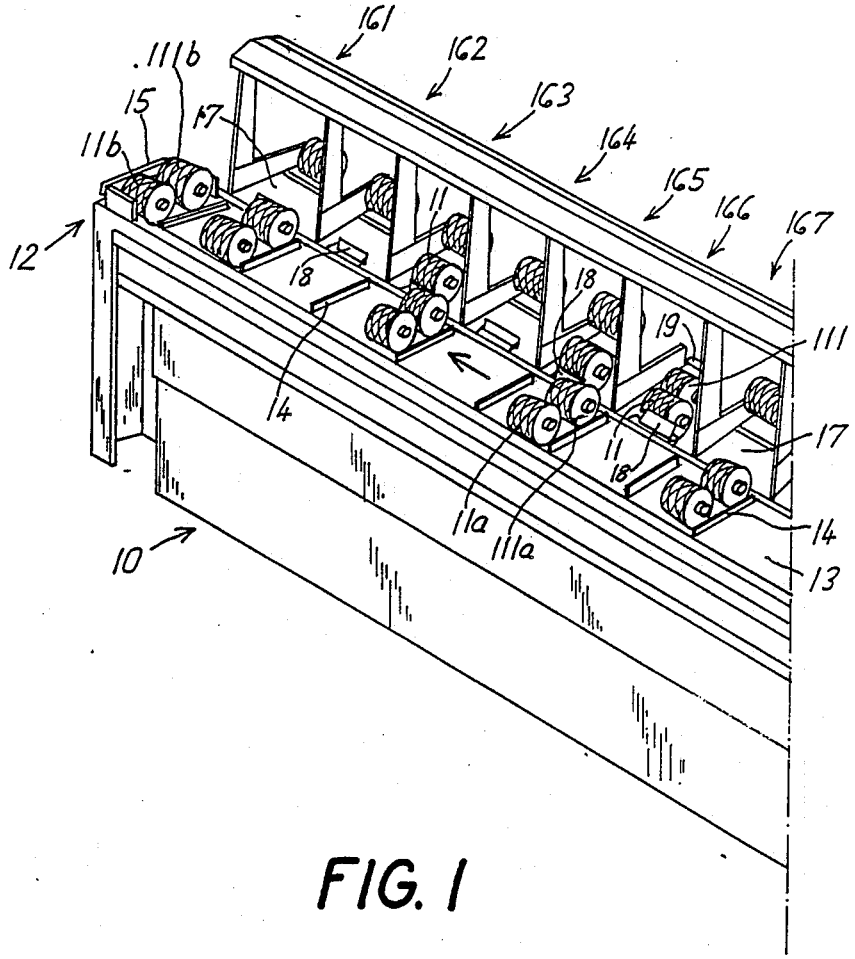
FIG. 1 is a perspective view of one preferred embodiment of the textile winding machine of the present invention.

In FIG. 1, the rear of a winding machine 10 is illustrated, with the machine operating to produce cross-wound packages 11 and 111 at each winding station 161–167 with the packages having different lengths of yarn wound thereon. The packages 11 and 111 at each station are delivered in pairs to a discharge end 12 of the winding machine by means of a conveyor in the form of a belt 13 of conventional construction.

Each winding station 161–167 is provided with a conventional length-measuring device for measuring the yarn length being wound on the packages at the station.

Conveyor belt 13 has dividers 14 for retaining the pairs of packages 11 and 111 separate from other pairs as the conveyor belt 13 progresses to the discharge end 12 at which a sensor 15 senses the presence of packages and stops travel of the conveyor 13 until the packages are removed.

Figure 2:
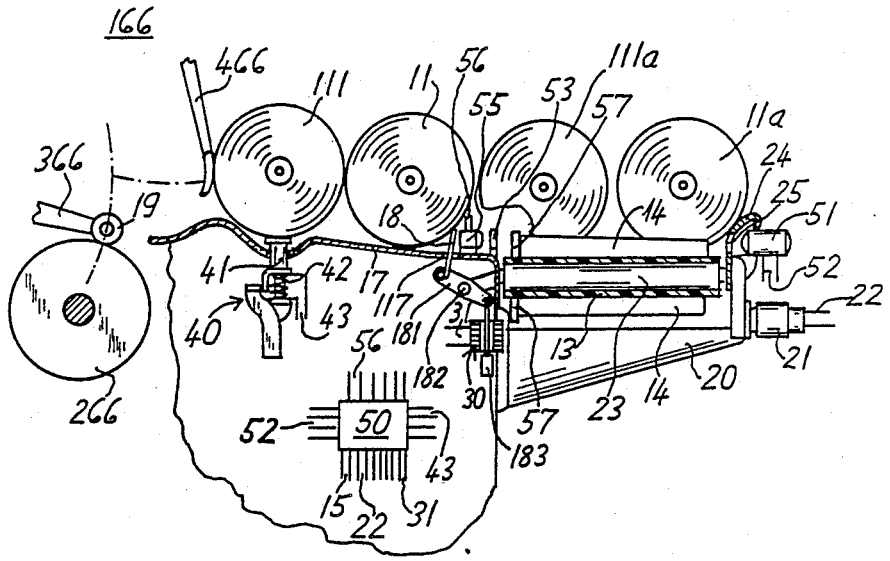
FIG. 2 is a partial side elevational view of one of the winding stations of the textile winding machine shown in FIG. 1.

At each winding station 161–167 there is package depositing means for the depositing the packages of the pairs from the winding station onto the conveyor. This package depositing means includes a package supporting platform 17 capable of receiving two packages 11 and 111 in pairs and releasing them onto the conveyor belt 13. As seen in FIGS. 1 and 2, the platform 17 is inclined toward the conveyor belt 13 and in line with the packages being wound so that the wound packages will be received directly onto the platform 17. However, the platform 17 can be arranged otherwise for suitable deposit of packages thereon.

As illustrated in FIG. 1, there is a releaseable stop 18 located in each platform adjacent the conveyor belt 13. The first wound package of the pair of packages wound at each winding station slides along the platform 17 into engagement with the releaseable stop 18 and is retained thereagainst while the second package 111 is produced and deposited onto the platform 17. The releaseable stop 18 then retains both packages 11 and 111 until an empty space on the conveyor 13 is sensed by conventional sensing means at the winding station, at which time the releaseable stop 18 is actuated to release both packages 11 and 111 in side-by-side disposition onto the conveyor 13.

In FIG. 2, the winding station 166 of FIG. 1 is illustrated in further detail and shows the winding station at a time immediately following the deposit of the second package 111 wound therat onto the platform 17. The first package 11 has previously been completed and deposited as well on the platform 17. The two packages 11 and 111 have different lengths of yarn wound thereon. The tube holder 366 of the winding station 166 has been provided with an empty tube 19, and the empty tube 19 has been moved into engagement with a winding roller 266 in preparation for winding yarn onto the empty tube 19. The transfer arm 466 of a conventional package transfer apparatus is in engagement with the second package 111 for subsequent actuation to push the package onto the platform 17.

The first package 11 is retained by the releaseable stop 18 on the platform 17 and prevented from rolling onto the conveyor belt 13. The releaseable stop 18 is formed of a generally vertical plate extending through a slot 117 in the platform 17, the plate having a length generally corresponding to the end-to-end length of the packages 11 and 111. The releaseable stop 18 is located generally parallel to and adjacent, the conveyor belt 13. The structure and operation of the releaseable stop 18 is conventional and is disclosed, for example, in U.S. Pat. No. 3,160,359 to fürst.

The lowes portion of the releaseable stop 18 is rotatably mounted to one end of a link 181 which is pivotably mounted by a pivot 182 to the winding machine. A counterweight 183 is pivotably mounted to the other end of the link 181 and operates to pivot the link 181 to dispose the releaseable stop 18 upwardly through the slot 117 into position for engaging and retaining the package 11 on the platform 17. The counterweight 183 is formed as the piston of an electromagnetic assembly 30 and is received in the hollow center of the electromagnetic assembly 30. The electromagnetic assembly 30 is operably connected by a connector 31 to a control apparatus 50, which controls the operation of the electromagnetic assembly 30 to selectively vertically move the releaseable stop 18 within the slot 117.

In its deposited position on the platform 17, the second package 111 rests on and depresses the contact shaft 41 of a contact assembly 40. The contact assembly 40 is connected by a connector 43 with the control apparatus 50. The second package 111 presses the contact shaft 41 against the bias of a spring 42 to close the contact of the contact assembly 40 and produce a signal transmitted via the connector 43 to the control apparatus 50 which indicates the presence of the second package 111 on the contact shaft 41.

The conveyor belt 13 is supported by a plurality of brackets 20 on the winding machine. A drive motor 21 drives a drive roller 23 around which the conveyor belt 13 is trained to move the conveyor belt 13 along the length of the winding machine. The drive motor 21 is connected by a connector 22 to the control apparatus 50 for control of the operation of the conveyor belt 13 by the control apparatus 50.

Thus, FIG. 2 illustrates the transfer of the pair of packages 11,111 having differing lengths of yarn onto the conveyor belt 13 for side-by-side transportation by the conveyor belt to an end station for unloading. The conveyor belt 13 has already been loaded with and is conveying packages 11*a* and 111*a*. The packages 11*a* and 111*a* are disposed on the conveyor belt 13 between a pair of dividers 14 mounted to the conveyor belt and extending generally transverse the direction of movement of the belt 13 (shown by the arrow in FIG. 1). The dividers 14 are generally equally spaced along the length of the conveyor belt 13. The packages 11*a* and 111*a* are transported by the conveyor belt 13 to respective exit positions 11*b* and 111*b* at an exit position 12 of the winding machine 10. To unload the packages 11 and 111 from the platform 17 onto the conveyor 13, the conveyor belt 13 must be advanced toward the exit position 12 until an empty space between a pair of adjacent dividers 14 is positioned adjacent the winding station 166. The presence of the packages in the space between each adjacent pair of the dividers 14 is determined by signals received from a reflector sensor 51 which is connected by connector 52 to the control apparatus 50. The reflective sensor 51 emits a light beam transversely to the direction of travel of the conveyor belt 13 which is reflected by a reflector 53 mounted on the wall separating the winding station 166 and the adjacent winding station in the direction of movement of the conveyor belt 13. Accordingly, when the space between an adjacent pair of the dividers 14 is occupied by a pair of packages such as the pair of packages 11*a*, 111*a*, the light beam between the reflective sensor 51 and its associated reflector 53 is interrupted as the packages are moved by the conveyor belt 13 through the emitted light beams. As shown in FIG. 2, the reflective sensor 51 is positioned to emit its light beam through a respective opening 25 in the guide plate 24 of the conveyor support which supports and guides the conveyor belt 13.

The transfer of the finished packages 11,111 which are disposed on the platform 17 of the winding station 166 is as follows. The package 111 is moved by the transfer arms 466 onto the platform 17 and the package thus presses on the contact shaft 41 to close the contact 40, which transmits a signal via the connector 43 to the control apparatus 50 indicating the presence of the package 111 on the platform 17. The control apparatus 50 then monitors the output of the reflective sensor 51 (shown in FIG. 2) to determine the presence of packages in the spaces between adjacent pairs of the dividers 14. Simultaneously, the control apparatus 50 monitors the reflective sensors 55 to monitor the passage therepast of the dividers 14.

The reflective sensor 51*e* emits a beam to the reflector 53*e* and, as an empty space between an adjacent pair of the dividers 14 moves into a position adjacent the platform 17 of the winding station 166, the light beam emitted by the reflective sensor 51*e* is no longer interrupted by packages traveling therepast and so it is continuosly reflected back to the sensor by the reflector 53 which, in turn, communicates this information to the control apparatus 50. In response to this information, the control apparatus 50 controls the conveyor belt 13 to stop once the respective reflector 57 mounted on the forwardmost of the pair of the dividers 14 between which there are no packages is aligned with its associated reflective sensor 55 mounted on the separation wall between the winding stations 165 and 166. The control apparatus 50 then controls the electromagnetic assembly 30 to raise the counterweight 183 upwardly into the hollow core of the electromagnetic assembly 30 through magnetic attraction. The upward movement of the counterweight 183 causes pivoting of the pivot 181 about the pivot 182 thereby moving the releaseable stop 18 downwardly through the slot 117. Once the releaseable stop 18 has been sufficiently downwardly moved, the packages 11,111 roll from the platform 17 onto the conveyor belt 13.

Once the package 111 rolls beyond the contact shaft 41 so as to relieve the pressure thereon, the contact assembly 40 again returns to its open condition and signals the control apparatus 50 accordingly. In response to the receipt of the signal from the contact assembly 40 indicating that the contact assembly 40 is in its open disposition, the control apparatus 50 actuates an adjustable time relay which controls the electromagnetic assembly 30 to maintain the releaseable stop 18 in its downward disposition until the package 111 has cleared the releaseable stop 18 and rolled onto the conveyor belt 13. Thereafter, the control apparatus 50 deactivates the electromagnetic assembly 30, causing the counterweight 183 to fall in response to gravitational forces, thereby moving the releaseable stop 18 upwardly through the slot 117 into its package retaining disposition. Simultaneously, the control apparatus 50 controls the drive motor 21 to drive the conveyor belt 13 to move the completed packages 11,111 to the exit position 12 whereat the packages can be removed in known manner, such as manually or with help of appropriate apparatus.

With this arrangement, the winding stations are controlled to first wind a package 11 with a predetermined length of yarn and then wind a second package 111 with a different length of yarn to thereby provide a pair of packages of suitable yarn length for use together in a subsequent doubling and twisting operation which can be transported intact as a discrete pair without intermingling with other wound packages to the end position 12 of the machine.

In FIGS. 3*a–c* and 4, another embodiment of the textile winding machine of the present invention is illustrated and is similarly configured to the embodiment described with respect to FIGS. 1 and 2 except that the aforementioned stop 18 is combined with a second releaseable stop 118 at each winding station 16*a–e*, with the stops 18 and 118 being spaced from one another sufficiently for a first wound package 11 to be dropped therebetween. The first stop 18 adjacent the conveyor 13 releaseably retains the first wound package 11 and the second stop 118 then operates to retain the second wound package 111 out of contact with the first wound package 11 and then the stops 18 and 118 are released successively to allow the packages to be deposited in sequential or end-to-end disposition on the conveyor 13 between a pair of the dividers 14 as the conveyor is advanced in a step-wise manner toward the end position 12.

Additionally, in the embodiment shown in FIGS. 3*a–c* and 4, a plurality of reflective sensors 55*a–f* are provided, each mounted to a respective separation wall separating the winding stations of the winding machine 10. Each reflective sensor 55*a–f* is connected by a connector 56 with the control apparatus 50. The reflective sensors 55*a–f* cooperate with a plurality of reflectors 57*a–f*, respectively, which are each mounted, respectively, to the end of one of the dividers 14 and adjacent the winding station side of the conveyor belt 13. The reflectors 55*a–f* serve as position markers.

Figure 4:
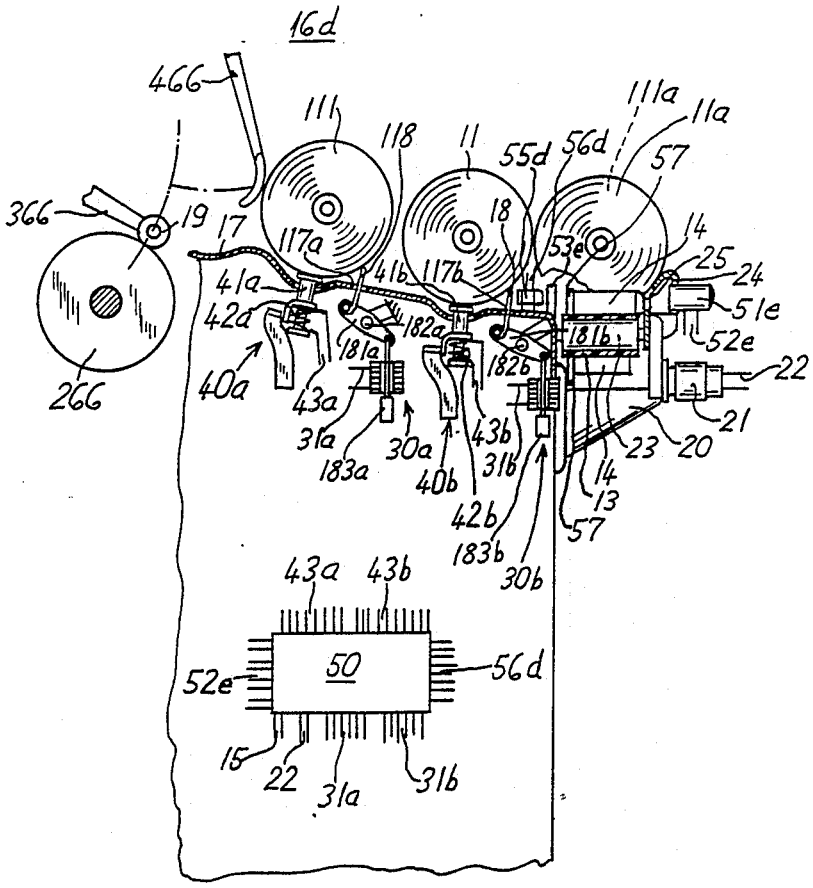
FIG. 4 is a partial side elevational view of the one winding station having a pair of packages in position for loading onto the conveyor shown in FIG. 3*a*.

With reference to FIGS. 3*a–c* and FIG. 4, the transfer of a pair of packages 11,111 of differing yarn length from the platform 17 of a winding station 16*d* to the conveyor belt 13 in end-to-end disposition is illustrated with each FIG. 3*a–c* illustrating a successive time in the transfer operation. As best seen in FIG. 4, the winding station 16*d* is generally similarly configured to the winding station 166 illustrated in FIG. 2, except that the winding station 16*d* includes two contact assemblies 40*a*,40*b*, two electromagnetic assemblies 30*a*,30*b*and two releaseable stops 18,118. Each respective contact assembly 40*a*,40*b* includes an associated contact shaft 41*a*,41*b*, respectively, and a spring 42*a*, 42*b*, respectively. Each electromagnetic assembly 30*a*,30*b*includes a counterweight 183*a*, 183*b* connected to one end of a link 181*a*,181*b*, respectively, for selectively moving the releaseable stops 118,18, respectively, with respect to their associated slots 117*a*,117*b*, respectively. Each contact assembly 40*a*,40*b* is connected to the control apparatus by a connector 43*a*,43*b*, respectively, and each electromagnetic assembly 30*a*,30*b* is connected to the control apparatus 50 by a connector 31*a*,31*b*, respectively. Additionally, the width of the conveyor belt 13 in the embodiment illustrated in FIGS. 3*a–c* and FIG. 4 is smaller that the width of the conveyor belt 13 with respect to the embodiment illustrated in FIG. 2. The space between the dividers 14 of the conveyor 13 is appropriately dimensioned so that a pair of packages can be disposed in end-to-end disposition between each adjacent pair of the dividers 14.

At the time of the operation shown in FIG. 3*a*, the winding station 16*d* has wound a pair of packages 11,111 of differing lengths of yarn and the packages are disposed on the platform 17 in preparation for loading onto the conveyor belt 13. The package 111 is retained on the platform 17 by the releaseable stop 118 and the package 11 is retained on the platform 17 by the releaseable stop 18. The package 11 press on the contact shaft 41*b* and thereby closes the contact assembly 40*b*, which signals the control apparatus 50 via the connector 43*b* to indicate the presence of the package 11 on the platform 17. Likewise, the package 111 presses the contact shaft 41*a* downwardly to close the contact assembly 40*a* which signals the control apparatus 50 via the connector 43*a* that the package 111 is disposed on the platform 17.

As shown in FIG. 3*a*, the conveyor belt 13 is operated under the control of the control apparatus 50 to move the packages disposed thereon to the end position 12 for unloading thereat. The reflective sensor 51*e* then transmits a light beam which is reflected back to it by the reflector 53*e* and the light beam is interrupted by the passage thereby of packages on the conveyor belt 13. As shown in FIG. 4, if the space between an adjacent pair of the dividers 14 is occupied by packages, such as the pair of packages 11*a*,111*a* disposed in end-to-end disposition as shown in FIG. 4, the conveyor belt 13 is operated to continue moving the conveyor toward the end position 12 until the reflective sensor 51*e* senses an empty space between an adjacent pair of the dividers 14 moving therepast. The control apparatus 50 then controls the conveyor belt 13 to stop once the reflector 57 on the forwardmost one of the pair of dividers 14 moves into alignment with the reflective sensor 55*d* mounted on the separation wall between the winding station 16*c* and 16*d*. The control apparatus 50 then actuates the electromagnet 30*b* to raise its associated counterweight 183*b* to thereby downwardly move the releaseable stop 18 through its associated slot 117*b*. The package 11 then rolls from the platform 17 onto the conveyor belt 13. Once the weight of the package 11 is released from the contact shaft 41*b*, the contact assembly 40*b* is again opened and a signal is transmitted by the connector 43*b* to the control apparatus 50 indicating that the contact assembly 40*b* is again open. The electromagnetic assembly 30*b* is then deactivated by the control assembly 50, thus allowing the counterweight 183*b* to fall downwardly to effect movement of the releaseable stop 18 upwardly through the associated slot 117*b*. Thereafter, the control apparatus 50 actuates the electromagnetic assembly 30*a* to upwardly move its associated counterweight 183*a* to thereby effect downward movement of the releaseable stop 118 with respect to its associated slot 117*a*. With the stop 118 downwardly moved, the package 111 is no longer restrained from rolling down the platform 17 and thus rolls downwardly along the platform 17 until contacting the releaseable stop 18, as shown in FIG. 3*b*, whereby the package 111 depresses the contact shaft 41*b* to close the contact assembly 40*b*. Once the weight of the package 111 is released from its contact shaft 41*a*, the contact assembly 40*a* is again opened and a signal is transmitted via the connector 43*a* to the control apparatus 50 to indicate the open position of the contact assembly 40*a*.

The control apparatus 50 then activates the drive motor 21 to further move the conveyor belt 13 until the reflector sensor 57 of the rearmost divider 14 of the pair of dividers 14 between which the packages 11,111 are to be disposed is aligned with the reflector 55*e*, as shown in FIG. 3*c*. The reflective sensor 55*e* signals the control apparatus 50 to stop the movement of the conveyor belt 13 and the control apparatus 50 then activates the electromagnetic assembly 30*b* to downwardly move the releaseable stop 18. Thereafter, the package 111 rolls from the platform 17 onto the conveyor belt 13 into end-to-end disposition with respect to the package 11 which had previously been loaded onto the conveyor 13.

With the weight of the package 111 released from its contact shaft 41*b*, the contact assembly 40*b* again opens and correspondingly signals the control apparatus 50. The control apparatus 50 then deactivates the electromagnetic assembly 30, whereby the releaseable stop 18 is again raised upwardly into its package retaining position. Simultaneously, the electromagnetic assembly 30*a* is activated to downwardly move the releaseable stop 118 so that the platform 17 is now in position to receive another finished package for rolling therealong into retaining engagement with the releaseable stop 18. Once a finished package has contacted the releaseable stop 18, the contact assembly 40*b* is closed due to the weight of the finished package on its contact shaft 41*b* and the signal is transmitted to the control apparatus 50, which then deactivates the electromagnetic assembly 30*a* to cause the releaseable stop 118 to move upwardly into its package retaining disposition.

As illustrated in FIG. 3*c*, once both the packages 11,111 have been loaded onto the conveyor belt 13, the control apparatus 50 activates the drive motor 22 to drive the conveyor belt 13 to effect delivery of the packages to the end position 12 for unloading thereat. The packages **11*b*,111*b* have already been off-loaded at the end position 12 and the sensor 15 senses the absence of packages and signals the control apparatus 50 to further advance the conveyor belt 13 to deliver additional packages to the end position 12**.

The pairs of packages **11*b* and 111*b* may be removed from the discharge end position 12 of the machine 10 manually or automatically for mounting in a subsequent machine, such as a two-for-one twister, where the longer length yarn package is mounted above the shorter yarn length package. A conveyor system can be positioned adjacent the end position 12** to receive and deliver the package pairs to additional discharge locations.

It is therefore readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A textile winding machine for producing discrete pairs of cross-wound yarn packages for subsequent simultaneous drawing of the yarn of both packages of each discrete pair of packages during a twisting and doubling operation, the length of yarn drawn from one package of each respective discrete pair of packages being different from the length of yarn drawn from the other package of the respective discrete pair of packages, said textile winding machine comprising:

a plurality of winding stations, each respective winding station producing packages in such a manner that each cross-wound yarn package has a length of yarn different than the length of yarn of the yarn package produced immediately thereafter at the same winding station;

means for conveying packages from said winding stations, said conveying means including means for maintaining discrete pairs of packages separate from other packages during the conveying thereof; and means for depositing wound pairs of packages from each winding station onto said discrete package pair maintaining means of said conveying means for conveyance by said conveying means as a discrete pair of packages separate from other packages, each deposited pair of packages including a first package produced at a respective winding station and the next package produced at the same respective winding station following the production of said first package.

2. A textile winding machine according to claim 1 and characterized further in that said conveying means comprises a conveyor for conveying wound packages from the winding stations to a discharge end of the machine, and said means for depositing pairs of said wound packages deposits packages from each said winding station onto said conveyor.

3. A textile winding machine according to claim 2 and characterized further in that said package depositing means includes means for depositing the packages of said pairs in side-by-side relation onto said conveyor.

4. A textile winding machine according to claim 2 and characterized further in that said package depositing means includes means for depositing the packages of said pairs in end-to-end relation onto said conveyor.

5. A textile winding machine according to claim 2 and characterized further in that said package depositing means includes a package supporting platform at each winding station and a stop assembly for supporting yarn packages at each winding station prior to depositing said packages in pairs onto said conveyor.

6. A textile winding machine according to claim 5 and characterized further in that said stop assembly includes at least one releasable stop at each winding station for retaining said packages on said platform and releasable to a clearance position for unobstructed movement of said packages along said platform past said releasable stop for controlled release of said pairs of packages for deposit onto said conveyor.

7. A textile winding machine according to claim 6 and characterized further in that said at least one stop comprises a single stop at each winding station, said stop being releasable to a clearance position for unobstructed movement of said packages along said platform past said releasable stop for depositing the packages of said pairs in side-by-side relation onto said conveyor.

8. A textile winding machine according to claim 6 and characterized further in that said at least one stop comprises two releasable stops at each winding station for separately retaining said packages and releasable to a clearance position for unobstructed movement of said packages along said platform past said releasable stop for depositing the packages of said pairs in sequence in end-to-end relation onto said conveyor.

* * * * *